US006408267B1

(12) United States Patent
Proust

(10) Patent No.: US 6,408,267 B1
(45) Date of Patent: Jun. 18, 2002

(54) METHOD FOR DECODING AN AUDIO SIGNAL WITH CORRECTION OF TRANSMISSION ERRORS

(75) Inventor: Stéphane Proust, Trelevern (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 09/402,529

(22) PCT Filed: Feb. 3, 1999

(86) PCT No.: PCT/FR99/00221

§ 371 (c)(1),
(2), (4) Date: Jan. 14, 2000

(87) PCT Pub. No.: WO99/40573

PCT Pub. Date: Aug. 12, 1999

(30) Foreign Application Priority Data

Feb. 6, 1998 (FR) ..... 98 01441

(51) Int. Cl.[7] ..... G10L 19/04
(52) U.S. Cl. ..... 704/210; 704/223; 704/220
(58) Field of Search ..... 704/223, 200, 704/226, 227, 228, 219, 220, 217, 218, 224

(56) References Cited

U.S. PATENT DOCUMENTS

| | | | | | |
|---|---|---|---|---|---|
| 5,450,449 | A | * | 9/1995 | Kroon | 704/219 |
| 5,615,298 | A | * | 3/1997 | Chen | 704/228 |
| 5,699,485 | A | * | 12/1997 | Shoham | 704/223 |
| 5,787,390 | A | | 7/1998 | Quinquis et al. | |
| 6,327,562 | B1 | * | 12/2001 | Proust | 704/201 |

FOREIGN PATENT DOCUMENTS

| | | |
|---|---|---|
| EP | 0459358 | 12/1991 |
| EP | 0673017 | 9/1995 |

OTHER PUBLICATIONS

Husain A et al., <<Classification and Spectral Extrapolation Based Packet Reconstruction for Low–delay Speech Coding>>, Proceedings of the Global Telecommunications Conference, Nov. 28, 1994, vol. 2, pp. 848–852.

Proust S et al., <<Dual Rate Low Delay CELP Coding (8kbits/s) using a Mixed Backward/Forward Adaptive LCP Prediction>>, Proc. Of the IEEE Workshop on Speech Coding for Telecommunications, Sep. 1995, pp. 37–38.

Maitra S et al., <<Speech Coding Using Forward and Backward Prediction>>, Conference Record, Nineteenth Asilomar Conference on Circuits, Systems and Computers (Cat. No. 86CH2331–7), Pacific Grove, CA, USA, Nov. 6–8, 1985, 1986, Washington, DC, USA, IEEE Comput. Soc. Press, USA, p. 214, col. 2–p. 215, col. 2.

* cited by examiner

*Primary Examiner*—Richemond Dorvil
(74) *Attorney, Agent, or Firm*—Marshall, Gerstein & Borun

(57) ABSTRACT

The decoder receives a bit stream representative of an audio signal, with a flag indicating any missing frames. For each frame, an excitation signal is formed from excitation parameters recovered in the bit stream if the frame is valid and estimated otherwise if the frame is missing, and the excitation signal is filtered by means of a synthesis filter to obtain a decoded audio signal. A linear prediction analysis is performed on the basis of the decoded audio signal obtained up to the preceding frame to estimate at least in part a synthesis filter relating to the current frame, whereby the successive synthesis filters used to filter the excitation signal, as long as there is no missing frame, conform to the estimated synthesis filters. If a frame $n_0$ is missing, at least one synthesis filter used to filter the excitation signal relative to a subsequent frame $n_0+i$ is determined by a weighted combination of the synthesis filter estimated in relation to frame $n_0+i$ and at least one synthesis filter that has been used since frame $n_0$.

33 Claims, 3 Drawing Sheets

METHOD FOR DECODING AN AUDIO SIGNAL WITH CORRECTION OF TRANSMISSION ERRORS

BACKGROUND OF THE INVENTION

The present invention concerns the field of digital coding of audio signals. It relates more particularly to a decoding method used to reconstitute an audio signal coded using a method employing a "backward LPC" synthesis filter.

Predictive block coding systems analyses successive frames of samples of the audio signal (generally speech or music) to be coded to extract a number of parameters for each frame. Those parameters are quantised to form a bit stream sent over a transmission channel.

Depending on the quality of the channel and the type of transport, the signal transmitted can be subject to interference causing errors in the bit stream received by the decoder. These errors in the bit stream can be isolated. However, they very frequently occur in bursts, especially in mobile radio channels with a high level of interference and in packet mode transmission networks. In this case, an entire packet of bits corresponding to one or more signal frames is erroneous or is not received.

The transmission system employed can frequently detect erroneous or missing frames at the level of the decoder. So-called "missing frame recovery" procedures are then used. These procedures enable the decoder to extrapolate the missing signal samples from samples recovered in frames preceding and possibly following the areas in which frames are missing.

The present invention aims to improve techniques for recovering missing frames in a manner that strongly limits subjective degradation of the signal perceived at the decoder in the presence of missing frames. It is of more particular benefit in the case of predictive coders using a technique generally known as "backward LPC analysis" continuously or intermittently. The abbreviation "LPC" signifies "linear predictive coding" and "backward" indicates that the analysis is performed on signals preceding the current frame. This technique is particularly sensitive to transmission errors in general and to missing frames in particular.

The most widely used linear prediction coding systems are CELP (Code-Excited Linear Predictive) coders. Backward LPC analysis in a CELP coder was used for the first time in the LD-CELP coder adopted by the ITV-T (see ITV-T Recommendation G.728). This coder can reduce the bit rate from 64 kbit/s to 16 kbit/s without degrading the perceived subjective quality.

Backward LPC analysis consists in performing the LPC analysis on the synthesised signal instead of on the current frame of the original audio signal. In reality, the analysis is performed on samples of the synthesised signal from frames preceding the current frame because that signal is available both at the coder (by virtue of local decoding that is generally useful in analysis-by-synthesis coders) and at the remote decoder. Because the analysis is performed at the coder and at the decoder, the LPC coefficients obtained do not have to be transmitted.

Compared to the more conventional "forward" LPC analysis, in which the linear prediction is applied to the signal at the input of the coder, backward LPC analysis provides a higher bit rate, which can be used to enrich the excitation dictionaries in the case of the CELP, for example. Also, and without increasing the bit rate, it significantly increases the order of analysis, the LPC synthesis filter typically having 50 coefficients for the LD-CELP coder as compared to 10 coefficients for most coders using forward LPC analysis.

Because of the higher order of the LPC filter, backward LPC analysis provides better modelling of musical signals, the spectrum of which is significantly richer than that of speech signals. Another reason why this technique is well suited to coding music signals is that music signals generally having a more stationary spectrum than speech signals, which improves the performance of backward LPC analysis. On the other hand, correct functioning of backward LPC analysis requires:

(i) A good quality synthesised signal, which must be very close to the original signal. This imposes a relatively high coding bit rate. Given the quality of current CELP coders, 13 kbit/s would seem to be the lower limit.

(ii) A short frame or a sufficiently stationary signal. There is a delay of one frame between the analysed signal and the signal to be coded. The frame length must therefore be short compared to the average time for which the signal is stationary.

(iii) Few transmission errors between the coder and the decoder. As soon as the synthesised signals are different, the coder and the decoder no longer calculate the same filter. Large divergences can then arise and be amplified, even in the absence of any new interference.

The sensitivity of backward LPC analysis coders/decoders to transmission errors is due mainly to the following recursive phenomenon: the difference between the synthesised signal generated at the coder (local decoder) and the synthesised signal reconstructed at the decoder by a missing frame recovery device causes a difference between the backward LPC filter calculated at the decoder for the next frame and that calculated at the coder, because these filters are calculated on the basis of the different signals. Those filters are used in turn to generate the synthesised signals of the next frame, which will therefore be different at the coder and at the decoder. The phenomenon can therefore propagate, increase in magnitude and cause the coder and decoder to diverge greatly and irreversibly. As backward LPC filters are generally of a high order (30 to 50 coefficients), they make a large contribution to the spectrum of the synthesised signal (high prediction gains).

Many coding algorithms use missing frame recovery techniques. The decoder is informed of a missing frame by one means or another (in mobile radio systems, for example, by receiving frame loss information from the channel decoder which detects transmission errors and can correct some of them). The objective of missing frame recovery devices is to extrapolate the samples of the missing frame from one or more of the most recent preceding frames which are deemed to be valid. Some systems extrapolate these samples using waveform substitution techniques which take samples directly from past decoded signals (see D. J. Goodman et al. : "Waveform Substitution Techniques for Recovering Missing Speech Segments in Packet Voice Communications", IEEE Trans. On ASSP, Vol. ASSP-34, No.6, December 1986). In the case of predictive coders, of the CELP type, for example, the samples of missing frames are replaced using the synthesis model used to synthesise the valid frames. The missing frame recovery procedure must then supply the parameters needed for the synthesis which are not available for the missing frames (see, for example, ITV-T Recommendations G.723.1 and G.729). Some parameters manipulated or coded by predictive coders exhibit high correlation between frames. This applies in particular to LPC parameters and to long-term prediction parameters (LTP delay and associated gain) for voiced sounds. Because of this correlation, it is more advantageous to use the parameters of the last valid frame again to synthesise the missing frame rather than to use erroneous or random parameters.

For the CELP coding algorithm, the parameters of the missing frame are conventionally obtained in the following manner:

- the LPC filter is obtained from the LPC parameters of the last valid frame, either by merely copying the parameters or introducing some damping;
- voiced/non-voiced detection determines the harmonic content of the signal at the level of the missing frame (cf. ITV-T Recommendation G.723.1);
- in the non-voiced situation, an excitation signal is generated in a partly random manner, for example by drawing a code word at random and using the past excitation gain slightly damped (cf. ITV-T Recommendation G.729), or random selection in the past excitation (cf. ITV-T Recommendation G.728);
- in the case of a voiced signal, the LTP delay is generally that calculated in the preceding frame, possibly with slight "jitter" to prevent an excessively prolonged resonant sound, and the LTP gain is made equal to 1 or very close to 1. The excitation signal is generally limited to the long-term prediction based on the past excitation.

In the case of a coding system using forward LPC analysis, the parameters of the LPC filter are extrapolated in a simple manner from parameters of the preceding frame: the LPC filter used for the first missing frame is generally the filter of the preceding frame, possibly damped (i.e. with the contours of the spectrum slightly flattened and the prediction gain reduced). This damping can be obtained by applying a spectral expansion coefficient to the coefficients of the filter or, if those coefficients are represented by LSP (line spectrum pairs), by imposing a minimum separation of the line spectrum pairs (cf. ITV-T Recommendation G.723.1).

The spectral expansion technique is proposed in the case of the coder of ITV-T Recommendation G.728, which uses backward LPC analysis: for the first missing frame, a set of LPC parameters is first calculated on the basis of the past (valid) synthesised signal. An expansion factor of 0.97 is applied to this filter, and this factor is iteratively multiplied by 0.97 for each new missing frame. Note that this technique is employed only if the frame is missing. On the first following frame that is not missing, the LPC parameters used by the decoder are those calculated normally, i.e. on the basis of the synthesised signal.

In the case of forward LPC analysis, there is no error memory phenomenon where the LPC filters are concerned, except on quantising the LPC filters used in a prediction (in which case mechanisms are provided for re-synchronising a predictor at the end of a particular number of valid frames, using leakage factors in the prediction, or an MA type prediction).

In the case of backward analysis, the error is propagated by way of the erroneous synthesised signal which is used at the decoder to generate the LPC filters of valid frames following the missing section. Improving the synthesised signal produced for the missing frame (extrapolation of the excitation signal and the gains) is therefore one way to guarantee that the subsequent LPC filters (calculated on the basis of the preceding synthesised signal) will be closer to those calculated at the coder.

The conditions (i) through (iii) mentioned above show that the limitations of pure backward analysis quickly become apparent for bit rates significantly less than 165 kbit/s. Apart from the reduced quality of the synthesised signal, which degrades the performance of the LPC filter, it is often necessary to accept a greater frame length (from 10 to 30 ms) in order to reduce the bit rate. Note that degradation then occurs primarily at spectrum transitions and more generally in areas which are not particularly stationary. In stationary areas, and for signals that are very stationary overall, such as music, backward LPC analysis has a very clear advantage over forward LPC analysis.

To retain the advantages of backward analysis, in particular good performance in coding musical signals, combined with reducing the bit rate, hybrid "forward/backward" LPC analysis coding systems have been developed (see S. Proust et al.: "Dual Rate Low Delay CELP Coding (8 kbits/s 16 kbits/s) using a Mixed Backward/Forward Adaptive LPC Prediction", Proc. Of the IEEE Workshop on Speech Coding for Telecommunications, September 1995, pages 37–38; and French Patent Application No. 97 04684corresponding to co-pending U.S patent application Ser. No. 09/202,753.

Combining both types of LPC analysis obtains the benefit of the advantages of both techniques: forward LPC analysis is used to code transitions and non-stationary areas and backward LPC analysis, of a higher order, is used to code stationary areas.

Introducing forward coded frames into the backward coded frames also enables the coder and the decoder to converge in the event of transmission errors, and therefore offers much greater robustness to such errors than pure backward coding. However, by far the greatest proportion of stationary signals are coded in the backward mode, for which the problem of transmission errors remains critical.

These hybrid forward/backward systems are intended for multimedia applications on networks with limited or shared resources, for example, or for enhanced quality mobile radio communications. In this type of application, the loss of packets of bits is highly probable, which represents an a priori penalty on techniques sensitive to missing frames, such as backward LPC analysis. By strongly reducing the effect of missing frames in systems using backward LPC analysis or hybrid forward/backward LPC analysis, the present invention is particularly suited to this type of application.

There are also other types of audio coding system using both forward LPC analysis and backward LPC analysis. The synthesis filter can in particular be a combination (convolution of the impulse responses) of a forward LPC filter and a backward LPC filter (see EP-A-0 782 128). The coefficients of the forward LPC filter are then calculated by the coder and transmitted in quantised form. The coefficients of the backward LPC filter are determined conjointly at the coder and at the decoder, using a backward LPC analysis process performed as explained above after submitting the synthesised signal to a filter that is the inverse of the forward LPC filter.

The aim of the present invention is to improve the subjective quality of the speech signal produced by the decoder, in predictive block coding systems using backward LPC analysis or hybrid forward/backward LPC analysis, when one or more frames is missing because of poor quality of the transmission channel or because a packet is lost or not received in a packet transmission system.

SUMMARY OF THE INVENTION

The invention therefore proposes, in the case of a system continuously using backward LPC analysis, a method of decoding a bit stream representative of an audio signal coded by successive frames, the bit stream being received with a flag indicating any missing frames, wherein, for each frame, an excitation signal is formed from excitation parameters which are recovered in the bit stream if the frame is valid and estimated some other way if the frame is missing, and the excitation signal is filtered by means of a synthesis filter to obtain a decoded audio signal, wherein a linear prediction analysis is performed on the basis of the decoded audio signal obtained up to the preceding frame to estimate at least in part a synthesis filter relating to the current frame, the successive synthesis filters used to filter the excitation signal as long as there is no missing frame conforming to the estimated synthesis filters, and wherein, if a frame $n_0$ is missing, at least one synthesis filter used to filter the excitation signal relative to a subsequent frame $n_0+i$ is determined by a weighted combination of the synthesis filter estimated in relation to frame $n_0+i$ and at least one synthesis filter that has been used since frame $n_0$.

For a number of frames after one or more missing frames, the backward LPC filters estimated by the decoder on the basis of the past synthesised signal are not those it actually uses to reconstruct the synthesised signal. To synthesise the latter, the decoder uses an LPC filter depending on the backward filter as estimated by this method, and also filters used to synthesise one or more preceding frames, since the last filter calculated on the basis of a valid synthesised signal. This is obtained by means of the weighted combination applied to the LPC filters following the missing frame, which performs a smoothing operation and forces a stationary spectrum, to some degree. This combination can vary with the distance to the last valid frame transmitted. The effect of smoothing the trajectory of the LPC filters used for synthesis after a missing frame is to limit strongly phenomena of divergence and thereby improve significantly the subjective quality of the decoded signal.

The sensitivity of backward LPC analysis to transmission errors is mainly due to the phenomenon of divergence previously explained. The main source of degradation is the progressive divergence of the filters calculated at the remote decoder and the filters calculated at the local decoder, which divergence can cause catastrophic distortion in the synthesised signal. It is therefore important to minimise the difference (in terms of spectral distance) between the two calculated filters and to have the difference tend towards zero as the number of error-free frames following the missing frame(s) increases (re-convergence property of the coding system). Backward filters, which are generally of a high order, have a capital influence on the spectrum of the synthesised signal. The convergence of the filters, which the invention encourages, assures the convergence of the synthesised signals. This improves the subjective quality of the synthesised signal in the presence of missing frames.

If frame $n_0+1$ following a missing frame $n_0$is also missing, the synthesis filter used to filter the excitation signal relating to frame $n_0+1$ is preferably determined from the synthesis filter used to filter the excitation signal relating to frame $n_0$. These two filters can be identical. The second could equally be determined by applying a spectral expansion coefficient, as previously explained.

In a preferred embodiment of the invention, weighting coefficients used in said weighted combination depend on the number i of frames between frame $n_0+i$ and the last missing frame no so that the synthesis filter used progressively approaches the estimated synthesis filter.

In particular each synthesis filter used to filter the excitation signal relating to a frame n is represented by K parameters $p^k(n)$ ($1 \leqq k \leqq K$) and the parameters $p^k(n_0+i)$ of the synthesis filter used to filter the excitation signal relating to a frame $n_0+i$, following i−1 valid frames ($i \geqq 1$) preceded by a missing frame $n_0$, are calculated from the equation:

$$P^k(n_0+i)=[1-\alpha(i)]\cdot P^k(n_0+i)+\alpha(i)\cdot P^k(n_0)$$

where $P^k(n_0+i)$ is the $k^{th}$ parameter of the synthesis filter estimated in relation to frame $n_0+i$ and $\alpha(i)$ is a positive or zero weighting coefficient decreasing with i from a value $\alpha(1)=\alpha_{max}$ at most equal to 1.

The decrease in the coefficient $\alpha(i)$ provides, in the first valid frames following a missing frame, a synthesis filter which is relatively close to that used for frame $n_0$, which has generally been determined under good conditions, and enables the memory of that filter to be progressively lost in frame $n_0$ so as to move towards the filter estimated for frame $n_0+i$.

The parameters $P_k(n)$ can be the coefficients of the synthesis filter, i.e. its impulse response. The parameters $P_k(n)$ can equally be other representations of those coefficients, such as those conventionally used in linear prediction coders: reflection coefficients, LAR (log-area-ratio), PARCOR (partial correlation), LSP (line spectrum pairs), etc.

The coefficient $\alpha(i)$ for i>1 can be calculated from the equation:

$$\alpha(i)=\max\{0,\alpha(i-1)-\beta\} \quad (2)$$

where $\beta$ is a coefficient in the range from 0 to 1.

In a preferred embodiment of the invention, the weighting coefficients employed in the weighted combination depend on an estimate ($I_{stat}(n)$) of the degree to which the spectrum of the audio signal is stationary so that, in the case of a weakly stationary signal, the synthesis filter used to filter the excitation signal relating to a frame $n_0+i$ following a missing frame $n_0$ ($i \geqq 1$) is closer to the estimated synthesis filter than in the case of a highly stationary signal.

The slaving of the backward LPC filter, and the resulting stationary spectrum, are therefore adapted as a function of a measured real average stationary signal spectrum. The smoothing (and therefore the stationary spectrum) is greater if the signal is really very stationary and reduced in the contrary case. The successive backward filters vary very little in the event of a very stationary spectrum. The successive filters can therefore be highly slaved. This limits the risk of divergence and assures the required stationary spectrum.

The degree to which the spectrum of the audio signal is stationary can be estimated from information included in each valid frame of the bit stream. In some systems, there is the option to set aside bit rate for transmitting this type of information, enabling the decoder to determine how stationary the spectrum of the coded signal is.

As an alternative to this, the degree to which the spectrum of the audio signal is stationary can be estimated from a comparative analysis of the successive synthesis filters used by the decoder to filter the excitation signal. It can be measured by various methods of measuring the spectral distances between the successive backward LPC filters used by the decoder (for example the Itakura distance).

The degree to which the spectrum of the signal is stationary can be allowed for in calculating the parameters of the synthesis filter using equation (1) above. The weighting coefficient $\alpha(i)$ for i>1 is then an increasing function of the estimated degree to which the spectrum of the audio signal is stationary. The signal used by the decoder therefore approaches the estimated filter more slowly when the spectrum is highly stationary is high than when it is not very stationary.

In particular, when $\alpha(i)$ is calculated from equation (2), the coefficient $\beta$ can be a decreasing function of the estimated degree to which the spectrum of the audio signal is stationary.

As stated above, the method of the invention can be applied to systems using only backward LPC analysis, for which the synthesis filter has a transfer function of the form $1/A_B(z)$, where $A_B(Z)$ is a polynomial in $z^{-1}$ whose coefficients are obtained by the decoder from the linear predictive analysis of the decoded audio signal.

It can also be applied to systems in which backward LPC analysis is combined with forward LPC analysis, with convolution of the impulse responses of the forward and backward LPC filters, in the manner described in EP-A-0 782 128. In this case, the synthesis filter has a transfer function of the form $1/[A_F(Z)\cdot A_B(Z)]$, where $A_F(Z)$ and $A_B(z)$ are polynomials in $z^{-1}$, the coefficients of the polynomial $A_F(z)$ being obtained from parameters included in valid frames of the bit stream and the coefficients of the polynomial ($A_B(z)$ being obtained by the decoder from the linear prediction analysis applied to a signal obtained by filtering the decoded audio signal using a filter with the transfer function $A_F(Z)$.

In the context of a hybrid forward/backward LPC analysis coding system, the present invention proposes a method of decoding a bit stream representative of an audio signal coded by successive frames, the bit stream being received with a flag indicating any missing frames, each valid frame of the bit stream including an indication of which coding mode was applied to code the audio signal relating to the frame, which is either a first coding mode in which the frame contains spectral parameters or a second coding mode, wherein, for each frame, an excitation signal is formed from excitation parameters which are recovered in the bit stream if the frame is valid and estimated some other way if the frame is missing, and the excitation signal is filtered by means of a synthesis filter to obtain a decoded audio signal, the synthesis filter used to filter the excitation signal being constructed from said spectral parameters if the bit stream indicates the first coding mode, wherein a linear prediction analysis is performed on the basis of the decoded audio signal obtained as far as the preceding frame to estimate at least in part a synthesis filter relating to the current frame and wherein, so long as no frame is missing and the bit stream indicates the second coding mode, the successive synthesis filters used to filter the excitation signal conform to the estimated synthesis filters, and wherein, if a frame $n_0$ is missing, the bit stream having indicated the second coding mode for the preceding valid frame and frame $n_0$ being followed by a plurality of valid frames for which the bit stream indicates the second coding mode, at least one synthesis filter used to filter the excitation signal relative to a subsequent frame $n_0+i$ is determined by a weighted combination of the synthesis filter estimated in relation to frame $n_0+i$ and at least one synthesis filter that has been used since frame $n_0$.

The above features cover the situation of missing frames in periods in which the coder is operating in the backward mode, in essentially the same manner as in systems using only backward coding.

The preferred embodiments described above for systems using only backward coding can be transposed directly to the situation of hybrid forward/backward systems.

It is interesting to note that the degree to which the spectrum of the audio signal is stationary, when used, can be estimated from information present in the bit stream to indicate the mode of coding the audio signal frame by frame.

The estimated degree to which the spectrum of the signal is stationary can in particular be deduced by counting down frames processed by the second coding mode and frames processed by the first coding mode belonging to a time window preceding the current frame and having a duration in the order of N frames, where N is a predefined integer.

In the event of missing frames when the coder is changing from the forward mode to the backward mode, if a frame $n_0$ is missing, the bit stream having indicated the first coding mode (or the second coding mode) for the preceding valid frame, the frame $n_0$ being followed by at least one valid frame for which the bit stream indicates the second coding mode, then the synthesis filter used to filter the excitation signal relating to the next frame $n_0+1$ can be determined from the estimated synthesis filter relating to frame $n_0$. The filter used to filter the excitation signal relating to the next frame $n_0+1$ can in particular be taken as identical to the estimated synthesis filter relating to frame $n_0$.

DESCRIPTION OF PREFERRED EMBODIMENTS

Figure 1:
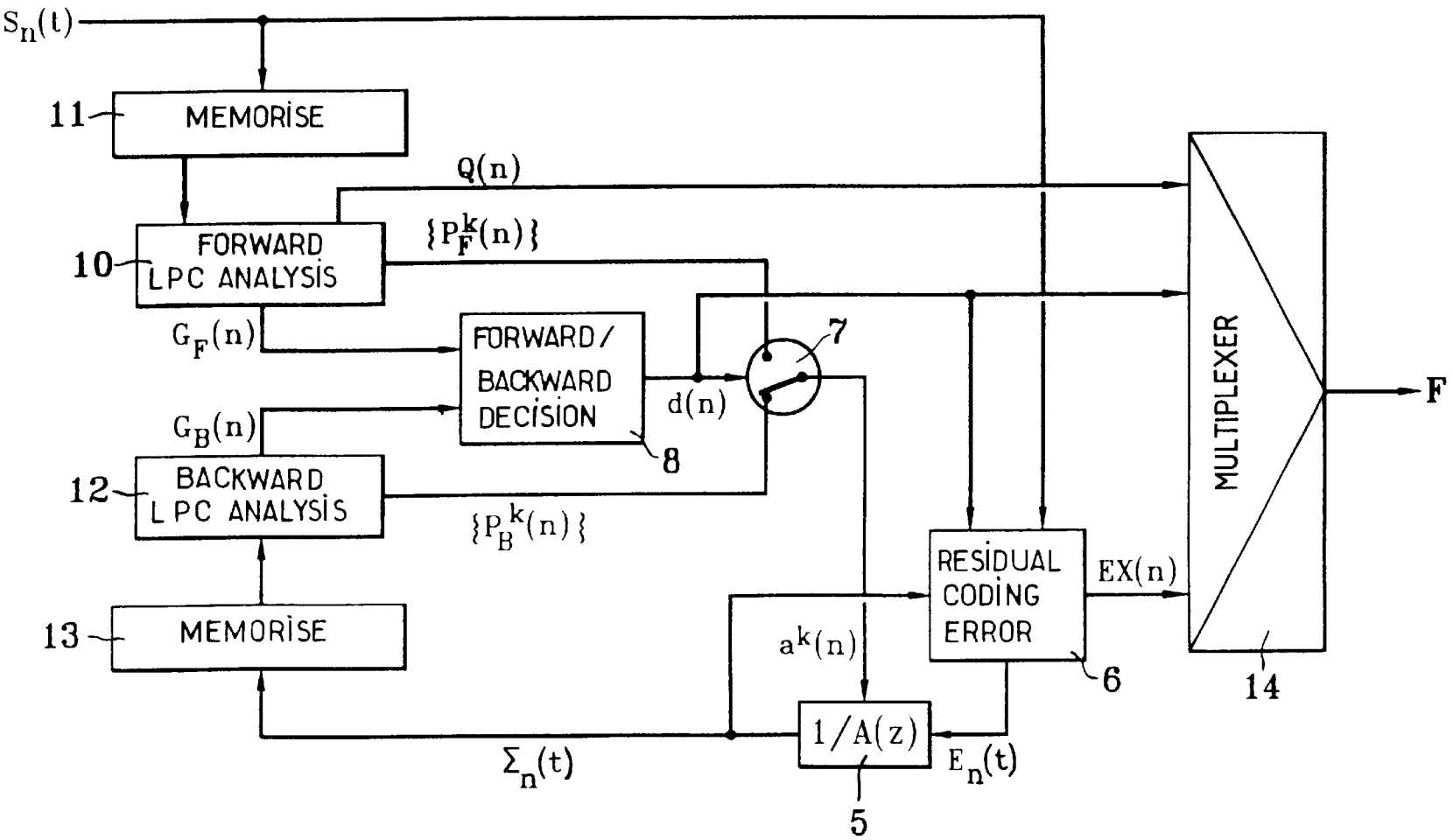
FIG. 1 is a block diagram of an audio coder whose output bit stream can be decoded in accordance with the invention.

The audio coder shown in FIG. 1 is a hybrid forward/backward LPC analysis coder.

The audio signal $S_n(t)$ to be coded is received in the form of successive digital frames indexed by the integer n. Each frame comprises a number L of samples. For example, the frame can have a duration of 10 ms, i.e. L=80 for a sampling frequency of 8 kHz.

The coder includes a synthesis filter 5 having a transfer function $1/A(z)$, where $A(z)$ is a polynomial in $z^{-1}$. The filter 5 is normally identical to the synthesis filter used by the associated decoder. The filter 5 receives an excitation signal $E_n(t)$ supplied by a residual error coding module 6 and locally forms a version $\Sigma_n(t)$ of the synthetic signal that the decoder produces in the absence of transmission errors.

The excitation signal $\Sigma_n(t)$ supplied by the module 6 is characterised by excitation parameters EX(n). The coding performed by the module 6 is aimed at making the local synthesised signal $\Sigma_n(t)$ as close as possible to the input signal $S_n(t)$ in the sense of a particular criterion. This criterion conventionally corresponds to minimising the coding error $\Sigma_n(t)-S_n(t)$ filtered by a filter with particular perceptual weighting determined on the basis of coefficients of the synthesis filter 5. The coding module 6 generally uses blocks shorter than the frames (sub-frames). Here the notation EX(n) denotes the set of excitation parameters determined by the module 6 for the sub-frames of frame n.

The coding module 6 can perform conventional long-term prediction to determine a long-term prediction delay and an associated gain allowing for the pitch of the speech, and a residual error excitation sequence and an associated gain.

The form of the residual error excitation sequence depends on the type of coder concerned. In the case of an MP-LPC coder, it corresponds to a set of pulses whose position and/or amplitude are quantised. In the case of a CELP coder, it corresponds to a code word from a predetermined dictionary.

The polynomial A(z), which is the inverse of the transfer function of the synthesis filter 5, is of the form:

$$A(z) = 1 + \sum_{k=1}^{K} a^k(n) \cdot z^{-k} \tag{3}$$

where the $a^k$ (n) are the linear prediction coefficients determined for frame n. As symbolised by the switch 7 in FIG. 1, they are supplied either by a forward LPC analysis module 10 or by a backward LPC analysis module 12, according to the value of a bit d(n) determined by a decision module 8 distinguishing frames for which the LPC analysis is performed forwards (d(n)=0) from frames for which the LPC analysis is performed backwards (d(n)=1).

The signal $S_n(t)$ to be coded is supplied to the linear prediction analysis module 10 which performs the forward LPC analysis of the signal $S_n(t)$. A memory module 11 receives the signal $S_n(t)$ and memorises it in an analysis time window which typically covers several frames up to the current frame. The module 10 performs a linear prediction calculation of order KF (typically KF≈10) on the signal $S_n(t)$ in this time window, to determine a linear prediction filter whose transfer $$A_F(z) = 1 + \sum_{k=1}^{KF} P_F^k(n) \cdot z^{-k} \tag{4}$$

where $P_F^k(n)$ designates the prediction coefficient of order k obtained after processing the frame n.

The linear prediction analysis methods that can be used to calculate these coefficients $P_F^k(n)$ are well-known in the field of digital coding. See, for example "Digital Processing of Speech Signals" by L. R. Rabiner and R. W. Shafer, Prentice-Hall Int., 1978, and "Linear Prediction of Speech" by J. D. Markel and A. H. Gray, Springer Verlag Berlin Heidelberg, 1976.

When d(n)=0 (forward mode), the coefficients $P_F^k(n)$ calculated by the module 10 are supplied to the synthesis filter 5, in other words K=KF and $a^k(n)=P_F^k(n)$ for $1 \leqq k \leqq K$. The module 10 also quantises the forward LPC filter. In this way it determines quantising parameters Q(n) for each frame for which d(n)=0. Various quantising methods can be used. The parameters Q(n) determining the frame n can represent the coefficients $P_F^k(n)$ of the filter directly. The quantising can equally be applied to the reflection coefficients, the LAR (log-area-ratio), the LSP (line spectrum pairs), etc. The coefficients $P_F^k(n)$ that are supplied to the filters 5 when d(n)=0 correspond to the quantised values.

The local synthesised signal $\Sigma_n(t)$ is supplied to the linear prediction analysis module 12 which performs the backward LPC analysis. A memory module 13 receives the signal $\Sigma_n(t)$ and memorises it in an analysis time window which typically covers a plurality of frames up to the frame preceding the current frame. The module 12 performs a linear prediction calculation of order KB (typically KB≈50) in this window of the synthesised signal to determine a linear prediction filter whose transfer function $A_B(Z)$ is of the form:

$$A_B(z) = 1 + \sum_{k=1}^{KB} P_B^k(n) \cdot z^{-k} \tag{5}$$

where $P_B^k(n)$ designates the prediction coefficient of order k after processing frame n−1.

The prediction methods employed by the module 12 can be the same as those employed by the module 10. However, the module 12 does not need to quantise the filter $A_B(z)$ When d(n)=1(backward mode), the coefficients $P_F^k(n)$ calculated by the module 12 are supplied to the synthesis filter 5, in other words K=KB and $a^k(n)=P_B^k(n)$ for $1 \leqq k \leqq K$.

Each of the modules 10, 12 supplies a prediction gain $G_F(n)$, $G_B(n)$ which it has maximised to obtain its respective prediction coefficients $P_F^k(n)$, $P_B^k(n)$. The decision module 8 analyses the value of the gains $G_F(n)$, $G_B(n)$ frame by frame to decide times at which the coder will operate in forward mode and in backward mode.

Generally speaking, if the backward prediction gain $G_B(n)$ is relatively high compared to the forward prediction gain $G_F(n)$, it may be assumed that the signal to be coded is somewhat stationary. If this is the case over a large number of consecutive frames, it is wise to operate the coder in backward mode, so that the module 8 takes d(n)=1. In contrast, in non-stationary areas, it takes d(n)=0. For a detailed description of a forward/backward decision method, see co-pending U.S. patent application Ser. No. 09/202,753.

FIG. 1 shows the output multiplexer 14 of the coder which formats the bit stream F. The stream F includes the forward/backward decision bit d(n) for each frame.

When d(n)=0 (forward mode), frame n of stream F includes the spectral parameters Q(n) which quantise the coefficients $P_F^k(n)$ of the forward LPC filter. The remainder of the frame includes the excitation parameters EX(n) determined by the module 6.

If d(n)=1 (backward mode), frame n of stream F does not contain any spectral parameters Q(n). The output binary bit rate being the same, more bits are available for coding the residual error excitation. The module 6 can therefore enrich the coding of the residual error either by allocating more bits to quantising some parameters (LTP delay, gains, etc.) or by increasing the size of the CELP dictionary.

For example, the binary bit rate can be 11.8 kbit/s for an ACELP (algebraic dictionary CELP) coder operating in the telephone band (300–3400 Hz), with 10 ms frames (L=80), forward LPC analysis of order KF=10, backward LPC analysis of order KB=30 and separation of each frame into two sub-frames (the forward and backward LPC filters calculated for each frame are used in processing the second sub-frame and interpolation between those filters and those calculated for the preceding frame is used in processing the sub-frame).

Figure 2:
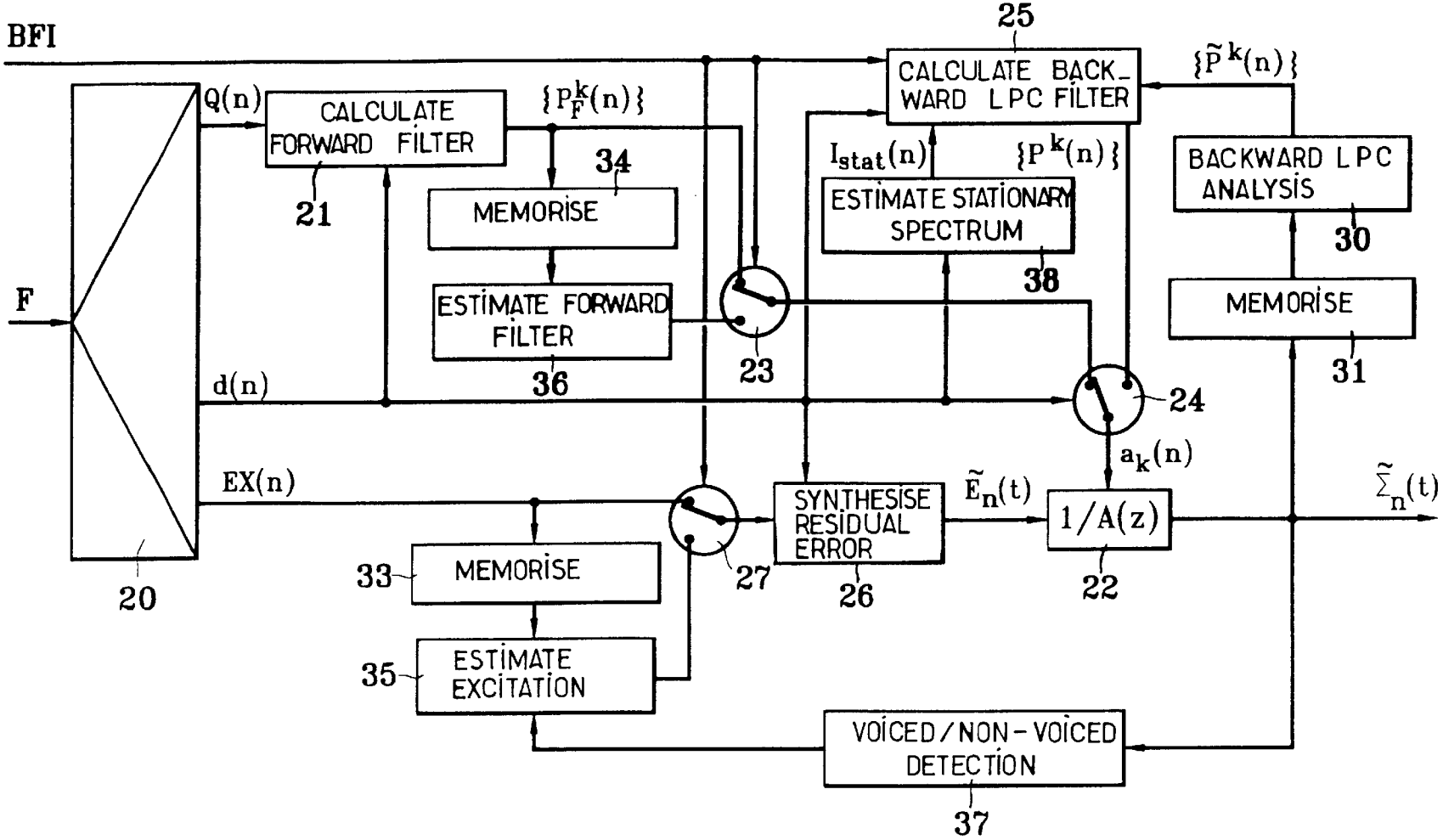
FIG. 2 is a block diagram of an audio decoder using a backward LPC filter in accordance with the present invention.

The decoder, of which FIG. 2 is a block diagram, receives a flag BFI indicating the missing frames, in addition to the bit stream F.

The output bit stream F of the coder is generally fed to a channel coder which introduces redundancy in accordance with a code having transmission error detection and/or correction capability. On the upstream side of the audio decoder, an associated channel decoder exploits this redundancy to detect transmission errors and possibly correct some of them. If the transmission of a frame is so bad that the correction capability of the channel decoder is insufficient, the latter activates the BFI flag in order for the audio decoder to adopt the appropriate behaviour.

FIG. 2 shows the input demultiplexer 20 of the decoder, which delivers, for each valid frame n of the received bit stream, the forward/backward decision d(n), the excitation parameters EX(n) and, if d(n)=0, the spectral parameters Q(n).

When a frame n is indicated as missing, the decoder deems the coding mode to remain identical to that of the last valid frame. It therefore adopts the value d(n)=d(n−1).

For a valid forward mode frame (d(n)=0 read in the bit stream F), the module 21 calculates the coefficients $P_F^k(n)$ of the forward LPC filter ($1 \leqq k \leqq KF$) from the received quantising indices Q(n). Switches 23, 24 being in the position shown in FIG. 2, the calculated coefficients $P_F^k(n)$ are fed to the synthesis filter 22 whose transfer function is then $1/A(z)=1/A_F(Z)$, with $A_F(Z)$ given by equation (3).

If d(n)=0 for a missing frame, the decoder continues to operate in forward mode, supplying coefficients $a^k(n)$ supplied by an estimator module 36 to the synthesis filter KF.

In the case of a backward mode frame n (d(n)=1 read in the bit stream or retained in the event of a missing frame), the coefficients of the synthesis filter 22 are coefficients $P_F^k(n)$ ($1 \leqq k \leqq K=KB$) determined by a module 25 for calculating the backward LPC filter, which is described later. The transfer function of the synthesis filter 22 is then 1/A(z), with $$A(z) = 1 + \sum_{k=1}^{KB} P^k(n) \cdot z^{-k} \tag{5}$$

The synthesis filter 22 receives for frame n an excitation signal $E_n(t)$ delivered by a module 26 for synthesising the LPC coding residue.

For a valid frame n, the synthesis module 26 calculates the excitation signal $E_n(t)$ from excitation parameters EX(n) read in the bit stream, the switch 27 being in the position shown in FIG. 2. In this case, the excitation signal $E_n(t)$ produced by the synthesis module 26 is identical to the excitation signal $E_n(t)$ delivered for the same frame by the module 6 of the coder. As in the coder, how the excitation signal is calculated depends on the forward/backward decision bit d(n).

The output signal $\Sigma_n(t)$ of the filter 22 constitutes the synthesised signal obtained by the decoder. This synthesised signal can then be conventionally submitted to one or more shaping post-filters (not shown) in the decoder.

The synthesised signal $\Sigma_n(t)$ is fed to a linear prediction analysis module 30 which performs the backward LPC analysis in the same manner as the module 12 of the decoder from FIG. 1 to estimate a synthesis filter whose coefficients $p^k(n)$ ($1 \leqq k \leqq KB$) are supplied to the calculation module 25. The coefficients $p^k(n)$ relating to frame n are obtained after allowing for the signal synthesised up to frame n−1. A memory module 31 receives the signal $\Sigma_n(t)$ and memorises it in the same analysis time window as the module 13 from FIG. 1. The analysis module 30 then performs the same calculations as the module 12 on the basis of the memorised synthesised signal.

As long as no frame is missing, the module 25 delivers coefficients $p^k(n)$ equal to the estimated coefficients $p^k(n)$ supplied by the analysis module 30. Consequently, provided that no frame is missing, the synthesised signal $\Sigma_n(t)$ delivered by the decoder is exactly identical to the synthesised signal $\Sigma_n(t)$ determined at the coder, on condition, of course, that there is no erroneous bit in the valid frames of the bit stream F.

The excitation parameters EX(n) received by the decoder and the coefficients $P_F^k(n)$ of the forward LPC filter if d(n)=0 are memorised for at least one frame by respective modules 33, 34, so that the excitation parameters and/or the forward LPC parameters can be restored if a frame is missing. The parameters used in this case are estimates supplied by the respective modules 35, 36 on the basis of the content of the memories 33, 34 if the BFI flag indicates a missing frame. The estimation methods that can be used by the modules 35 and 36 can be chosen from the methods referred to above. In particular, the module 35 can estimate the excitation parameters allowing for information on the more or less voiced character of the synthesised signal $\Sigma_n(t)$ supplied by a voiced/non-voiced detector 37.

Recovering the coefficients of the backward LPC filter when a missing frame is indicated follows on from the calculation of the coefficients $p^k(n)$ by the module 25. The calculation advantageously depends on an estimate $I_{stat}(n)$ of the degree to which the spectrum of the audio signal is stationary produced by an estimator module 38.

Figure 3:
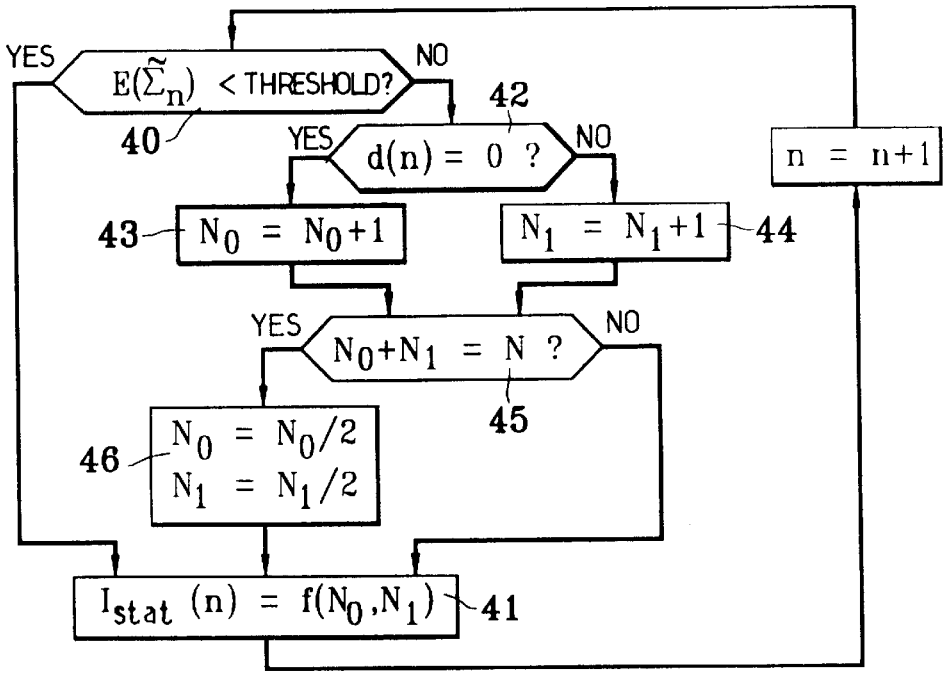
FIG. 3 is a flowchart of a procedure for estimating the degree to which the spectrum of the signal is stationary which can be applied in the decoder from FIG. 2.

The module 38 can operate in accordance with the flowchart shown in FIG. 3. In this procedure, the module 38 uses two counters whose values are denoted $N_0$ and $N_1$. Their ratio $N_1/N_0$ is representative of the proportion of frames forward coded in a time window defined by a number N whose duration represents the order of N signal frames (typical N≈100, i.e. a window in the order of 1 s).

The estimate $I_{stat}(n)$ for frame n is a function f of the numbers $N_0$ and $N_1$. It can in particular be a binary function, for example:

$f(N_0, N_1)=1$ if $N_1>4N_0$ (relatively Stationary), or $f(N_0, N_1)=0$ if $N_1 \leqq 4N_0$ (relatively unstationary)

If the energy $E(\Sigma_n)$ of the synthesised signal $\Sigma_n$ (t) delivered by the filter 22 in the current frame n is below a threshold chosen so that insufficiently energetic frames are ignored (test 40), the counters $N_0$ and $N_1$ are not modified in frame n and the module 38 calculates $I_{stat}(n)$ directly in step 41. If not, in test 42 it examines the coding mode indicated for frame n (d(n) read in the bit stream or d(n)=(n−1) in the case of a missing frame). If d(n)=1, counter $N_0$ is incremented in step 43. If d(n)=1, counter $N_1$ is incremented in step 44. The mode 38 then calculates $I_{stat}(n)$ in step 41, unless the sum $N_0+N_1$ reaches the number N (test 45), in which case the values of the two counters $N_0$ and $N_1$ are first divided by 2.

Figure 4:
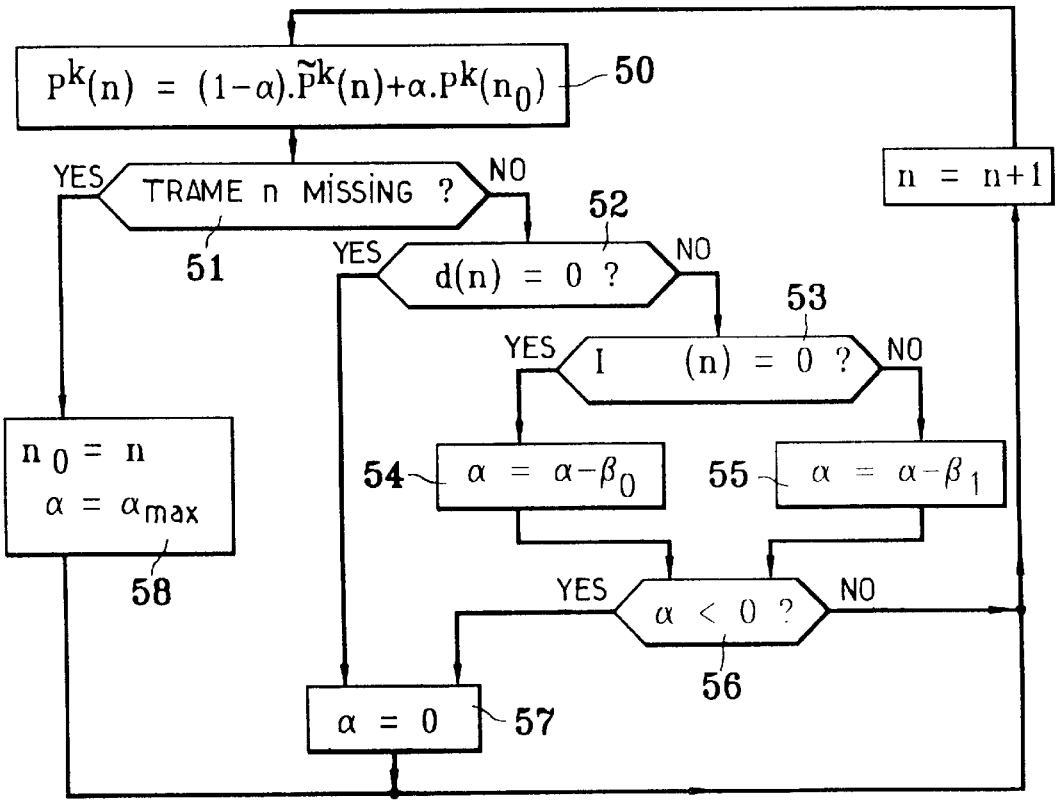
FIG. 4 is a flowchart of the backward LPC filter calculation that can be applied in the decoder from FIG. 2.

The procedure for calculation of the coefficients $P^k(n)$ ($1 \leqq k \leqq KB$) by the module 25 can conform to the FIG. 4 flowchart. Note that this procedure is executed for all the n frames, whether valid or missing, and whether forward or backward coding is used. The filter calculated depends on a weighting coefficient α which in turn depends on the number of frames that have elapsed since the last missing frame and the successive estimates $I_{stat}(n)$. The index of the last missing frame preceding the current frame is denoted $n_0$.

At the start of the processing performed for a frame n, the module 25 produces the KB coefficients $P^k(n)$ which, if d(n)=1, are supplied to the filter 22 for synthesising the signal Σ(n) of frame n. If d(n)=0, the coefficients $P^k(n)$ are simply calculated and memorised. The calculation is performed in step 50, using the equation:

$$P^k(n)=(1\alpha)\cdot P^k(n)+\alpha\cdot P^k(n_0) \tag{6}$$

in which $P^k(n)$ are the coefficients estimated by the module 30 relating to frame n (i.e. allowing for the signal synthesised up to frame n−1), $P^k(n_0)$ are the coefficients calculated by the module 25 relating to the last missing frame $n_0$, and α is the weighting coefficient, initialised to 0.

Equation (7) corresponds to equation (1) when at least one valid frame $n_0+i$ follows the missing frame $n_0$ (i=1,2, . . . ).

If frame n is valid (test 51), the module 25 examines the forward/backward decision bit d(n) read in the bit stream in step 52.

If d(n)=1, the module 25 calculates the new value of the coefficient $\alpha$ according to equation (2) in steps 53 to 57, the coefficient $\beta$ being chosen as a decreasing function of $I_{stat}(n)$ as estimated by the module 38 relative to frame n. If $I_{stat}(n)=0$ in step 53 (relatively unstationary signal), the coefficient $\alpha$ is reduced by an amount $\beta=\beta_0$ in step 54. If $I_{stat}(n)=1$ in step 53 (relatively stationary signal), the coefficient $\alpha$ is reduced by an amount $\beta=\beta_1$ in step 55. If $I_{stat}(n)$ is determined in a binary manner, as explained above, the quantities $B_0$ and $B_1$ can be respectively equal to 0.5 and 0.1. In step 56, the new value of $\alpha$ is compared to 0. The processing relating to frame n is terminated if $\alpha>0$. If $\alpha<0$, the coefficient $\alpha$ is set to 0 in step 57.

In the case of a forward coded frame n (d(n)=0 in step 52), the coefficient $\alpha$ is set directly to 0 in step 57.

If frame n is missing (test 51), the index n of the current frame is allocated to the index $n_0$ designating the last missing frame and the coefficient $\alpha$ is initialised to its maximum value $\alpha_{max}$ in step 58 ($0<\alpha_{max}\leqq 1$).

The maximum value $\alpha_{max}$ of the coefficient $\alpha$ can be less than 1. Nevertheless, the value $\alpha_{max}=1$ is preferably chosen. In this case, if frame $n_0$ is missing, the next filter $p^k(n_0+1)$ calculated by the module 25 corresponds to the filter it calculated after receiving the last valid frame. If there is a plurality of successive missing frames, the filter calculated by the module 25 remains equal to that calculated after receiving the last valid frame.

If the first valid frame received after a missing frame is forward coded ($d(n_0+1)=0$), the synthesis filter 22 receives the valid coefficients $P_F^k(n_0+1)$ calculated by the module 21 and a valid excitation signal. Consequently, the synthesised signal $\Sigma_{n0+1}(t)$ is relatively reliable, like the estimate $P^k(n_0+2)$ of the synthesis filter performed by the analysis module 30. Because coefficient $\alpha$ is set to zero in step 57, this estimate $p^k(n_0+2)$ can be adopted by the calculation module 25 for the next frame $n_0+2$.

If the first valid frame received after a frame loss is backward coded ($d(n_0+1)=1$), the synthesis filter 22 receives the coefficient $p^k(n_{0+}1)$ for that valid frame. The choice $\alpha_{max}=1$ completely avoids the need to allow for the estimate $p^k(n_0+1)$ determined relatively unreliably by the module 30 after processing the synthesised signal $\Sigma_{n0}(t)$ of the missing frame no in calculating the coefficients ($\Sigma_{n0}(t)$ was obtained by filtering an erroneous excitation signal).

If the subsequent frames $n_0+2$, etc. are still backward coded, the synthesis filter used will be smoothed using the coefficient $\alpha$ whose value is reduced more or less quickly according to whether the signal area is less or more stationary. After a particular number of frames (10 in the static case, and 2 frames in the non-stationary case with the indicated values of $\beta_1$ and $\beta_0$), the coefficient $\alpha$ is zero again, in other words, the filter $p^k(n_0+i)$ used if the coding mode remains the backward mode becomes identical to the filter $p^k(n_0+i)$ estimated by the module 30 from the synthesised signal.

The foregoing description explains in detail the example of a hybrid forward/backward coding system. The use of the invention is very similar in the case of a coder using only backward coding:

the output bit stream F does not contain the decision bit d(n) and the spectral parameters Q(n), but only the excitation parameters EX(n), the functional units 7, 8, 10 and 11 of the coder from FIG. 1 are not needed, the coefficients $P_B^k(n)$ calculated by the backward LPC analysis module 12 being used directly by the synthesis filter 5, and the functional units 21, 23, 24, 34 and 36 of the decoder from FIG. 2 are not needed, the coefficients $p^k(n)$ calculated by the module 25 being used directly by the synthesis filter 22.

The decision bit d(n) no longer being available in the decoder, if the calculation module 25 uses $I_{stat}(n)$, it must be calculated some other way. If the bit stream transmitted does not contain any particular information enabling the decoder to estimate $I_{stat}(n)$, the estimate can be based on a comparative analysis of the synthesis filters $p^k(n)$ successively calculated by the module 25. If the spectral distances measured between the successive filters remain relatively small over a particular time window, the signal can be deemed to be relatively stationary.

What is claimed is:

1. A method of decoding a bit stream representative of an audio signal coded by successive frames, the bit stream being received with a flag indicating any missing frames, comprising the following steps for each frame:

forming an excitation signal from excitation parameters which are recovered in the bit stream if the frame is valid and estimated otherwise if the frame is missing, filtering the excitation signal by means of a synthesis filter to obtain a decoded audio signal, whereby the synthesis filter relating to the current frame is at least in part estimated from a linear prediction analysis performed on the basis of the decoded audio signal obtained up to the preceding frame, wherein the successive synthesis filters used to filter the excitation signal as long as there is no missing frame are in accordance with the estimated synthesis filters, and wherein, if a frame $n_0$ is missing, at least one synthesis filter used to filter the excitation signal relative to a subsequent frame $n_0+i$ is determined by a weighted combination of the synthesis filter estimated in relation to frame $n_0+i$ and at least one synthesis filter that has been used since frame $n_0$.

2. A method according to claim 1 wherein, if frame $n_0+1$ following a missing frame $n_0$ is also missing, the synthesis filter used to filter the excitation signal relating to frame $n_0+1$ is determined from the synthesis filter used to filter the excitation signal relating to frame $n_0$.

3. A method according to claim 1 wherein weighting coefficients used in said weighted combination depend on the number i of frames between frame $n_0+i$ and the last missing frame no so that the synthesis filter used progressively approaches the estimated synthesis filter.

4. A method according to claim 3 wherein each synthesis filter used to filter the excitation signal relating to a frame n is represented by K parameters $p^k(n)$ ($1\leqq k\leqq K$) and wherein the parameters $p^k(n_0+i)$ of the synthesis filter used to filter the excitation signal relating to a frame $n_0+i$, following i−1 valid frames ($i\geqq 1$) preceded by a missing frame $n_0$, are calculated from the equation:

$$P^k(n_0+i)=[1-\alpha(i)]\cdot P^k(n_0+i)+\alpha(i)\cdot P^k(n_0)$$

where $p^k(n_0+i)$ is the $k^{th}$ parameter of the synthesis filter estimated in relation to frame $n_0+i$ and $\alpha(i)$ is a positive or zero weighting coefficient decreasing with i from a value $\alpha(1)=\alpha_{max}$ at most equal to 1.

5. A method according to claim 4 wherein $\alpha(1)=\alpha_{max}$.

6. A method according to claim 4 wherein the coefficient $\alpha(i)$ for $i>1$ is calculated from the equation $\alpha(i)=\max\{0, \alpha(i-1)-\beta\}$ where $\beta$ is a coefficient in the range from 0 to 1.

7. A method according to claim 1, wherein weighting coefficients employed in said weighted combination depend on an estimate of a degree to which a spectrum of the audio signal is stationary so that, in the case of a weakly stationary signal, the synthesis filter used to filter the excitation signal relating to a frame $n_0+i$ following a missing frame $n_0$ ($i \geqq 1$) is closer to the estimated synthesis filter than in the case of a highly stationary signal.

8. A method according to claim 7 wherein the degree to which the spectrum of the audio signal is stationary is estimated from information contained in each valid frame of the bit stream.

9. A method according to claim 7 wherein the degree to which the spectrum of the audio signal is stationary is estimated from a comparative analysis of the successive synthesis filters used to filter the excitation signal.

10. A method according to claim 4, wherein the weighting coefficients $\alpha(i)$ employed in said weighted combination depend on an estimate of a degree to which a spectrum of the audio signal is stationary so that, in the case of a weakly stationary signal, the synthesis filter used to filter the excitation signal relating to a frame $n_0+i$ following a missing frame $n_0$ ($i \geqq 1$) is closer to the estimated synthesis filter than in the case of a highly stationary signal, and wherein the weighting coefficient $\alpha(i)$ for $i>1$ is an increasing function of the estimated degree to which the spectrum of the audio signal is stationary.

11. A method according to claim 10, wherein the coefficient $\alpha(i)$ for $i>1$ is calculated from the equation $\alpha(i)=\max\{0, \alpha(i-1)-\beta\}$ where $\beta$ is a coefficient in the range from 0 to 1, the coefficient $\beta$ being a decreasing function of the estimated degree to which the spectrum of the audio signal is stationary.

12. A method according to claim 11 wherein the degree to which the spectrum of the audio signal is stationary is estimated in a binary manner, the coefficient $\beta$ taking the value 0.5 or 0.1 according to the estimate.

13. A method according to claim 1, wherein the synthesis filter has a transfer function of the form $1/A_B(z)$ where $A_B(z)$ is a polynomial in $z^{-1}$ having coefficients obtained from said linear prediction analysis applied to the decoded audio signal.

14. A method according to claim 1, wherein the synthesis filter has a transfer function of the form $1/[A_F(z).A_B(z)]$ where $A_F(z)$ and $A_B(z)$ are polynomials in $z^{-1}$, wherein coefficients of the polynomial $A_F(z)$ are obtained from parameters included in valid frames of the bit stream and wherein coefficients of the polynomial $A_B(z)$ are obtained from said linear prediction analysis applied to a signal obtained by filtering the decoded audio signal using a filter having the transfer function $A_F(z)$.

15. A method of decoding a bit stream representative of an audio signal coded by successive frames, the bit stream being received with a flag indicating any missing frames, each valid frame of the bit stream including an indication of which coding mode was applied to code the audio signal relating to the frame, among a first coding mode in which the frame contains spectral parameters and a second coding mode, the method comprising the following steps for each frame:

forming an excitation signal from excitation parameters which are recovered in the bit stream if the frame is valid and estimated otherwise if the frame is missing, filtering the excitation signal by means of a synthesis filter to obtain a decoded audio signal, wherein the synthesis filter used to filter the excitation signal is constructed from said spectral parameters if the bit stream indicates the first coding mode, whereby the synthesis filter relating to the current frame is at least in part estimated from a linear prediction analysis performed on the basis of the decoded audio signal obtained up to the preceding frame, wherein, so long as no frame is missing and the bit stream indicates the second coding mode, the successive synthesis filters used to filter the excitation signal are in accordance with the estimated synthesis filters, and wherein, if a frame $n_0$ is missing, the bit stream having indicated the second coding mode for the preceding valid frame and frame $n_0$ being followed by a plurality of valid frames for which the bit stream indicates the second coding mode, at least one synthesis filter used to filter the excitation signal relative to a subsequent frame $n_0+i$ is determined by a weighted combination of the synthesis filter estimated in relation to frame $n_0+i$ and at least one synthesis filter that has been used since frame $n_0$.

16. A method according to claim 15 wherein, if a frame $n_0$ is missing and is followed by at least one valid frame for which the bit stream indicates the second coding mode, the synthesis filter used to filter the excitation signal relative to the subsequent frame $n_0+i$ is determined from the synthesis filter estimated in relation to frame $n_0$.

17. A method according to claim 15 wherein, if two consecutive frames $n_0$ and $n_0+i$ are both missing, the bit stream having indicated the second coding mode for the preceding valid frame, the synthesis filter used to filter the excitation signal relative to frame $n_0+i$ is determined from the synthesis filter used to filter the excitation signal relative to frame $n_0$.

18. A method according to claim 15, wherein weighting coefficients employed in said weighted combination depend on the number i of frames between frame $n_0+i$ and the last missing frame $n_0$ so that the synthesis filter used progressively approaches the estimated synthesis filter.

19. A method according to claim 18 wherein each synthesis filter used to filter the excitation signal relating to a frame n for which the bit stream indicates the second coding mode is represented by K parameters $p^k(n)$ ($1 \leqq k \leqq K$) and wherein the parameters $P^k(n_0+i)$ of the synthesis filter used to filter the excitation signal relating to a frame $n_0+i$, for which the bit stream indicates the second coding mode, following i−1 valid frames ($i \geqq 1$) preceded by a missing frame no, are calculated from the equation:

$$P^k(n_0+i)=[1-\alpha(i)]\cdot P^k(n_0+i)+\alpha(i)\cdot P^k(n_0)$$

where $P^k(n_0+i)$ is the $k^{th}$ parameter of the synthesis filter estimated in relation to frame $n_0+i$ and $\alpha(i)$ is a positive or zero weighting coefficient decreasing with i from a value $\alpha(1)=\alpha_{max}$ at most equal to 1.

20. A method according to claim 19 wherein $\alpha_{max}=1$.

21. A method according to claim 19 wherein the coefficient $\alpha(i)$ for $i>1$ is calculated using the equation $\alpha(i)=\max(0, \alpha(i-1)-\beta)$, $\beta$being a coefficient in the range from 0 to 1.

22. A method according to claim 15, wherein weighting coefficients employed in said weighted combination depend on an estimate of a degree to which a spectrum of the audio signal is stationary so that, in the case of a weakly stationary signal, the synthesis filter used to filter the excitation signal relating to a frame $n_0+i$ following a missing frame $n_0$ and for which the bit stream indicates the second mode ($i \geqq 1$) is closer to the estimated synthesis filter than in the case of a strongly stationary signal.

23. A method according to claim 22 wherein the degree to which the spectrum of the audio signal is stationary is estimated from information included in each valid frame of the bit stream.

24. A method according to claim 23 wherein said information from which the degree to which the spectrum of the audio signal is stationary is estimated is the information indicating the audio signal coding mode.

25. A method according to claim 24 wherein the estimated degree to which the spectrum of the audio signal is stationary is deduced by downcounting frames processed in the second coding mode and frames processed in the first coding mode belonging to a time window preceding the current frame and having a duration in the order of N frames, N being a predefined integer.

26. A method according to claim 25, wherein the degree to which the spectrum of the audio signal is stationary is estimated recursively using two counters, wherein one of said two counters has a value $N_0$ incremented for each frame processed using the first coding mode, wherein the other one of said two counters has a value $N_1$ incremented for each frame processed using the second coding mode, wherein the values of the two counters are both reduced when the sum of the two values reaches the number N, and wherein the estimated degree to which the spectrum of the audio signal is stationary is an increasing function of the ratio $N_1/N_0$.

27. A method according to claim 26 wherein the estimated degree to which the spectrum of the audio signal is stationary is a binary function of the ratio $N_1/N_0$.

28. A method according to claim 22 wherein the degree to which the spectrum of the audio signal is stationary is estimated from a comparative analysis of the successive synthesis filters used to filter the excitation signal.

29. A method according to claim 19 wherein weighting coefficients $\alpha(i)$ employed in said weighted combination depend on an estimate of a degree to which a spectrum of the audio signal is stationary so that, in the case of a weakly stationary signal, the synthesis filter used to filter the excitation signal relating to a frame $n_0+i$ following a missing frame $n_0$ and for which the bit stream indicates the second mode ($i \geqq 1$) is closer to the estimated synthesis filter than in the case of a strongly stationary signal, and wherein the weighting coefficient $\alpha(i)$ for $i>1$ is an increasing function of the estimated degree to which the spectrum of the audio signal is stationary.

30. A method according to claim 29, wherein the coefficient $\alpha(i)$ for $i>1$ is calculated using the equation $\alpha(i)=\max(0, \alpha(i-1)-\beta)$, $\beta$ being a coefficient in the range from 0 to 1, the coefficient $\beta$ being a decreasing function of the estimated degree to which the spectrum of the audio signal is stationary.

31. A method according to claim 30 wherein the coefficient $\beta$ takes the value 0.5 or 0.1 according to the estimated degree to which the spectrum of the audio signal is stationary.

32. A method according to claim 15, wherein the synthesis filter used when the bit stream indicates the second coding mode has a transfer function of the form $1/A_B(z)$, where $A_B(z)$ is a polynomial in $z^{-1}$ having coefficients obtained from said linear prediction analysis applied to the decoded audio signal.

33. A method according to claim 15, wherein the synthesis filter used when the bit stream indicates the second coding mode has a transfer function of the form $1/[A_F.A_B(z)$, where $A_F(z)$ and $A_B(z)$ are polynomials in $z^{-1}$, wherein coefficients of the polynomial $A_B(z)$ are obtained from parameters included in valid frames of the bit stream, and wherein coefficients of the polynomial $A_B(z)$ are obtained from said linear prediction analysis applied to a signal obtained by filtering the decoded audio signal using a filter with the transfer function $A_F(z)$.

* * * * *

UNITED STATES PATENT AND TRADEMARK OFFICE

CERTIFICATE OF CORRECTION

PATENT NO. : 6,408,267 B1
DATED : June 18, 2002
INVENTOR(S) : Stephane Proust

It is certified that error appears in the above-identified patent and that said Letters Patent is hereby corrected as shown below:

Title page,
Item [54], Title, replace "FOR" with -- OF --.

Column 14,
Line 49, please delete "no" and insert -- $n_0$ --;
Line 53, please delete "$p^k$ (n) ($1 \leqq k \leqq K$) and insert -- $P^k$ (n) ($1 \leq k \leq K$) --;
Line 54, please delete "$p^k$ ($n_0$ + i)" and insert -- $P^k$ ($n_0$ + i) --;
Line 56, please delete "($i \geqq 1$)" and insert -- ($i \geq 1$) --;
Line 59, please delete "($p^K$ ($n_0$ + i)" and insert -- $P^k$ ($n_0$ + i) --;

Column 15,
Line 6, please delete "($i \geqq 1$)" and insert -- ($i \geq 1$) --;
Line 22, please delete "($i \geqq 1$)" and insert -- ($i \geq 1$) --;

Column 16,
Line 39, please delete "$p^k$ (n) ($1 \leqq k \leqq K$) and insert -- $P^k$ (n) ($1 \leq k \leq K$) --;
Line 43, please delete "($i \geqq 1$)" and insert -- ($i \geq 1$) --;
Line 54, please delete "βbeing" and insert -- β being --;
Line 61, please delete "($i \geqq 1$)" and insert -- ($i \geq 1$) --;

Column 18,
Line 2, please delete "($i \geqq 1$)" and insert -- ($i \geq 1$) --;

Signed and Sealed this

Nineteenth Day of November, 2002

*Attest:*

*Attesting Officer*

JAMES E. ROGAN
*Director of the United States Patent and Trademark Office*